US007121242B2

(12) United States Patent
Inui et al.

(10) Patent No.: US 7,121,242 B2
(45) Date of Patent: Oct. 17, 2006

(54) LUBRICATING STRUCTURE OF OHC INTERNAL COMBUSTION ENGINE

(75) Inventors: Hiroatsu Inui, Saitama (JP); Takanori Osuka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/801,557

(22) Filed: Mar. 17, 2004

(65) Prior Publication Data

US 2004/0226528 A1 Nov. 18, 2004

(30) Foreign Application Priority Data

Mar. 27, 2003 (JP) ..... 2003-087693

(51) Int. Cl.
*F01M 1/06* (2006.01)

(52) U.S. Cl. ..... 123/90.33; 123/90.27; 123/90.34

(58) Field of Classification Search ..... 123/90.33, 123/90.27, 90.34
See application file for complete search history.

(56) References Cited

U.S. PATENT DOCUMENTS 4,524,853 A * 6/1985 Nagai ..... 192/18 R
5,704,330 A * 1/1998 Tsuchida ..... 123/193.5

FOREIGN PATENT DOCUMENTS

JP 62-11294 Y2 3/1987

* cited by examiner

*Primary Examiner*—Thomas Denion
*Assistant Examiner*—Zelalem Eshete
(74) *Attorney, Agent, or Firm*—Birch, Stewart, Kolasch & Birch, LLP

(57) ABSTRACT

A lubricating structure for an OHC internal combustion engine including a cam holder, wherein an oil feed path for feeding a lubricant to an upper end of a valve stem is formed integrally with the cam holder so as to project therefrom.

23 Claims, 7 Drawing Sheets

LUBRICATING STRUCTURE OF OHC INTERNAL COMBUSTION ENGINE

CROSS-REFERENCE TO RELATED APPLICATION

The present application claims priority under 35 U.S.C. §119 to Japanese Patent Application No. 2003-087693, filed Mar. 27, 2003, the entire contents of which are hereby incorporated by reference.

BACKGROUND OF THE INVENTION

1. Field of the Invention

The present invention relates to a lubricating structure in an OHC internal combustion engine and, more specifically, to a lubricating structure with respect to the periphery of a valve stem.

2. Description of Background Art

In the OHC (Over Head Camshaft) type internal combustion engine provided with a camshaft on a cylinder head above a combustion chamber, pressure oil is supplied to a valve system of the camshaft or the valve stem located above by an oil pump driven by the operation of the internal combustion engine.

In the related art, lubricant for the valve stem is guided to the upper end of the valve stem from an oil path formed in a rocker arm. However, since the rocker arm, being relatively complex in structure, is a pivoting member, there arises a problem in that forming the oil path therein makes the structure further complex, and thus results in increase in production cost.

Accordingly, a method of guiding lubricant to the upper end of the valve stem through a lubricant guide attached to a camshaft holder is proposed (For example, see Patent document JP-UM-B-62-11294).

In JP-UM-B-62-11294, a structure in which the separate lubricant guide and the camshaft holder are secured together by two mounting bolts of the camshaft holder is disclosed.

Mounting bolt holes which the mounting bolts of the camshaft holder pass through are used as lubricant paths, and lubricant guided from the lubricant paths through an oil groove and an oil feed hole to the upper surface of the lubricant guide and accumulated is guided by the lubricant guide and supplied to the upper end of the valve stem.

In the construction described above, since the lubricant guide which is separate from the camshaft holder is secured together with the camshaft holder with the mounting bolt, the number of components increases and the assemblability is lowered and hence the cost is increased.

SUMMARY AND OBJECTS OF THE INVENTION

In view of such circumstances, an object of the present invention is to provide a lubricating structure of an OHC-type internal combustion engine in which the number of components is reduced and the assemblability is improved at a low cost.

In order to achieve the object described above, a first aspect of the present invention provides an OHC-type internal combustion engine comprising a cam holder, characterized by a lubricating structure in which an oil feed path for feeding lubricant to the upper end of a valve stem is formed integrally with the cam holder so as to project therefrom.

Since the oil feed path for feeding lubricant to the upper end of the valve stem is formed integrally with the cam holder so as to project therefrom, the number of components is reduced, and it is not necessary, for example, to secure a plurality of components together with a single screw. Therefore, reliability is improved, satisfactory assemblability is achieved, and the cost is reduced.

According to a second aspect of the present invention, the oil feed path of the lubricating structure of the OHC-type internal combustion engine has a trough-like shape.

By forming the oil feed path into a trough-like shape, lubricant can easily be guided to the upper end of the valve stem.

According to a third aspect of the present invention, a projection protruding downward is formed at an exit of the oil feed path.

By forming the projection protruding downward at the exit of the oil feed path, lubricant can easily run down along the surface of the projection and drops exactly onto a lubricating site.

According to a fourth aspect of the present invention, a part of the lubricant for lubricating a cam is supplied to the oil feed path.

By utilizing the oil path for feeding lubricant to the cam, it is not necessary to additionally provide an oil path specific for lubricating the valve stem, and lubricant can easily be guided to the oil feed path.

According to a fifth aspect of the present invention, a plurality of valves are arranged in the direction of a camshaft, and the oil feed paths provided on the respective valves are formed with oil paths in communication therewith so as to be independent from each other.

By forming the oil paths in communication with the oil feed paths provided in the respective valves so as to be independent from each other, lubricant can be fed equally to the respective valve stems irrespective of the posture of the internal combustion engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Referring now to FIG. 1 to FIG. 12, one embodiment of the present invention will be described.

An OHC-type internal combustion engine 1 according to the present embodiment is a horizontal, V-type two-cylinder oriented in the fore-and-aft direction, and water-cooled internal combustion engine to be mounted to a motorcycle, having crankshafts oriented laterally and horizontally of the vehicle body.

Figure 1:
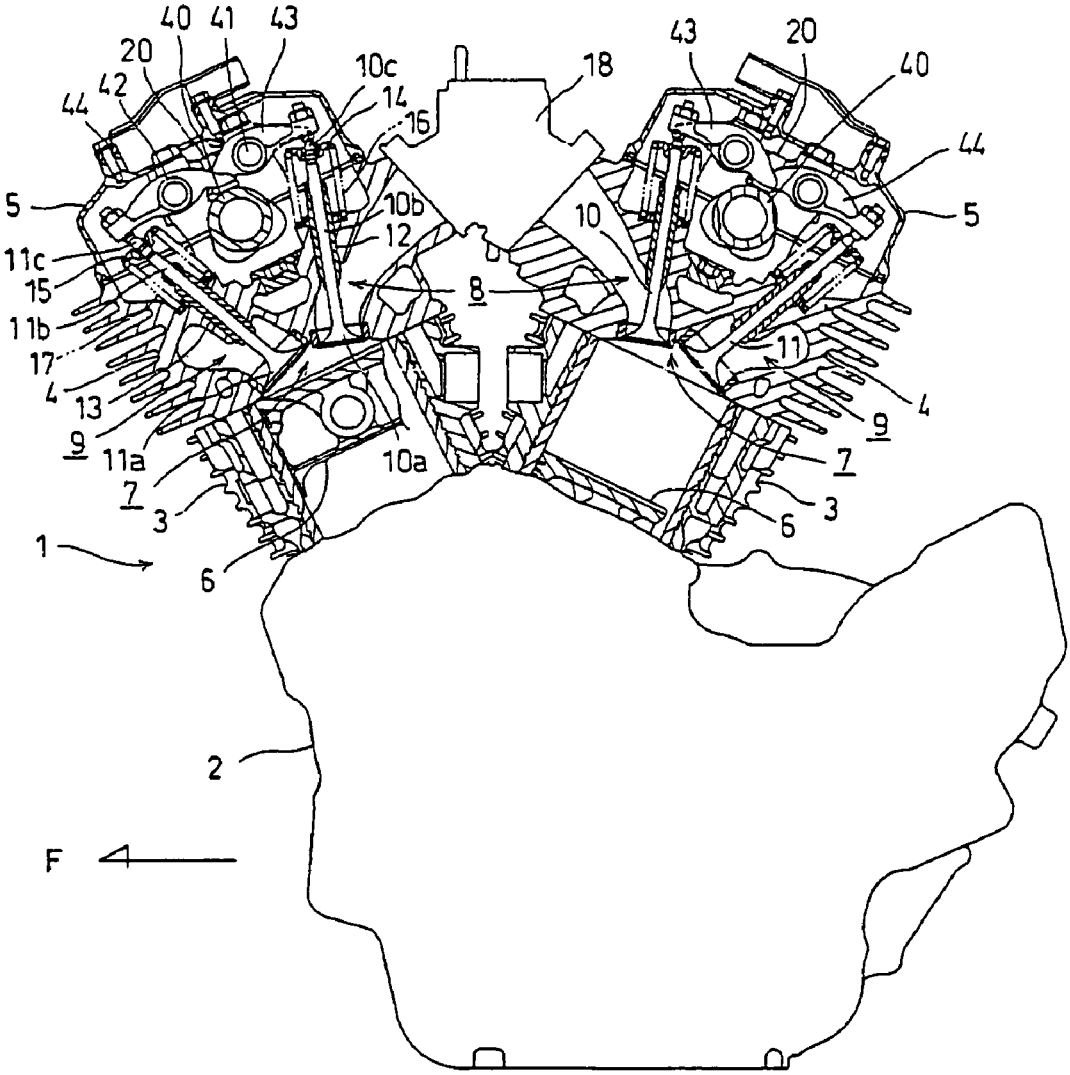
FIG. 1 is a side view, partially in cross-section, of an internal combustion engine according to one embodiment of the present invention.
Figure 2:
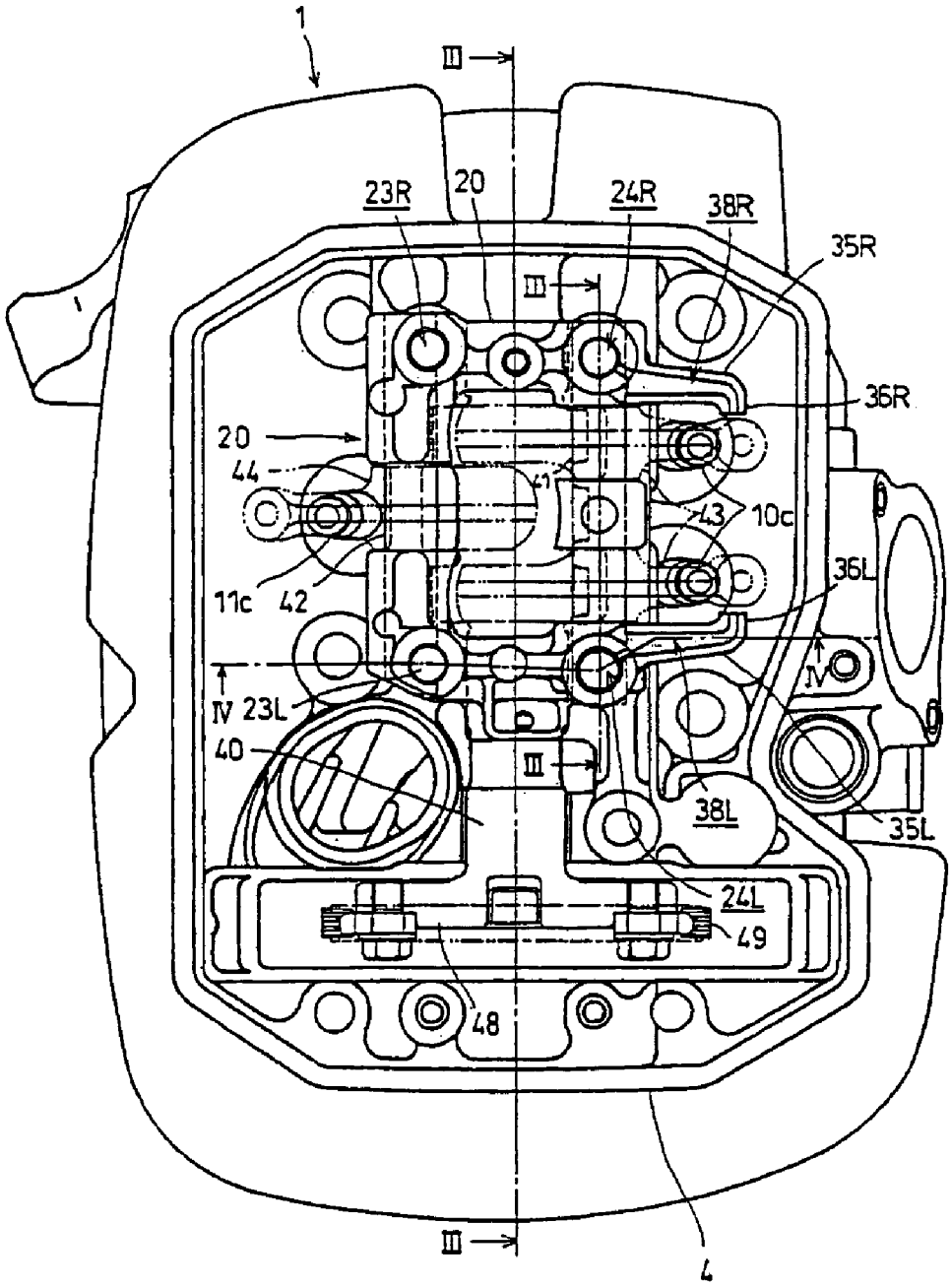
FIG. 2 is a plan view of a principal portion.

Referring now to FIG. 1, the internal combustion engine 1 includes an engine case 2 having a crankcase and a transmission case behind the crankcase and being located on the lower side thereof, and cylinder blocks 3, 3, cylinder heads 4, 4, and cylinder head covers 5, 5, placed on top of another respectively in sequence into a V-shape in side view on the engine case 2 so as to integrally project therefrom.

A piston 6 is slidably fitted into a bore of each cylinder block 3, and two intake ports 8, 8 and an exhaust port 9 formed in the cylinder head open into a combustion chamber 7 located at the inner bottom of the cylinder head 4, to which the piston 6 faces.

Air intake valves 10, 10 are provided in a state in which valve bodies 10*a*, 10*a* are exposed to openings of these two intake ports 8, 8, so as to be capable of opening and closing the openings, and an exhaust valve 11 is provided in a state in which a valve body 11*a* is exposed to an opening of the exhaust port 9 so as to be capable of opening and closing the opening.

The air intake valve 10 and the exhaust valve 11 are projected upwardly from the cylinder head 4 at stem ends 10*c*, 11*c* thereof in a state in which valve stems 10*b*, 11*b* are slidably supported by valve guides 12, 13.

Valve springs 16, 17 are interposed between spring bearings 14, 15 provided around the stem ends 10*c*, 11*c* and the cylinder head 4 respectively, and urge the air intake valve 10 and the exhaust valve 11 to the valve-closing direction.

Since the intake ports 8 are located on the inner sides of the cylinder heads 4, 4 inclined into a V-shape oriented in the fore-and-aft direction, and the exhaust ports 9 are located on the outer sides thereof, the intake ports 8 are located at a higher level than the exhaust ports 9, and thus the stem end 10*c* of the air intake valve 10 for opening and closing the intake port 8 is located at a higher level than the stem end 11*c* of the exhaust valve 11 for opening and closing the exhaust port 9.

The front and the rear intake ports 8, 8 extending inwardly of the cylinder heads 4, 4 are connected to a carburetor 18 disposed between the front and the rear cylinder heads 4, 4.

A cam holder 20 for rotatably clamping a camshaft 40 with respect to the cylinder head 4 is mounted to the top of the center of the cylinder head 4 in the fore-and-aft direction.

Referring now to FIG. 5 to FIG. 12, the cam holder 20 to be mounted to the front cylinder head 4 will be described.

The cam holder 20 is formed generally into a rectangular frame shape in plan view, and includes left and right shorter side portions 21L, 21R protruding upwardly and facing with respect to each other, and front and back longer side portions 22F, 22B connecting the left and the right shorter side portions 21L, 21R at the lower ends thereof. At four corners, that is, at both ends of the longer side portions 22F, 22B, there are formed bolt insertion holes 23L, 23R, 24L, 24R in the vertical direction.

On the reverse faces of the left and the right shorter side portions 21L, 21R, coaxial semi-arcuate surfaces 25L, 25R for clamping the camshaft 40 oriented in the lateral direction are hollowed out, and the reverse faces of the front and the back longer side portions 22F, 22B and the peripheries of the bolt insertion holes 23L, 23R, 24L, 24R on both ends thereof define mating surfaces 26, 27 with respect to the cylinder head 4.

The opposing shorter side portions 21L, 21R are formed at the front and the back thereof with circular holes 28, 29 respectively for supporting a pair of front and rear rocker arm shafts 41, 42 oriented in the lateral direction.

The circular holes 28, 29 are orthogonal to the bolt insertion holes 23L, 23R, 24L, 24R.

A partition 22*a* is formed at the center of the longer side portion 22B on the backside of the cam holder 20 so as to protrude therefrom and the partition 22*a* is also formed with the circular hole 29.

The longer side portion 22B on the reverse face of the cam holder 20 includes an extension 30 on the left side, and a bolt mounting boss 31, including a bolt insertion hole 31*a* formed therein, is formed at the end thereof. The back sides of the extension 30 and the bolt mounting boss 31 form the mating surface 27.

The mating surface 27 is formed with oil groove 32 for communicating with a bolt insertion hole 31*a* and the bolt insertion hole 24L at the left rear comer closest thereto.

The semi-arcuate surfaces 25L, 25R clamping the camshaft 40 are formed with oil grooves 33L, 33R in the circumferential direction, and the oil grooves 33L, 33R are communicating with the bolt insertion holes 24L, 24R, respectively, on the back side thereof.

Furthermore, a pair of left and right nose portions 35L, 35R are formed so as to project rearward from the top of the rear surface of the left and the right shorter side portions 21L, 21R of the cam holder 20 and to face to each other.

The nose portions 35L, 35R are triangular shape in side view, and the upper surfaces incline downward.

The distal ends of the left and the right nose portions 35L, 35R are slightly bent toward each other, and projections 37L, 37R are suspended downward along the distal end surface of the distal end bent portions 36L, 36R facing to each other.

The inclined upper surfaces of the nose portions 35L, 35R are formed with oil feed paths 38L, 38R like a trough extending from the rear upper portions of the proximal shorter side portions 21L, 21R toward the distal ends, and then bent along the distal end bent portions 36L, 36R until the openings at the end surface.

On the upper opening end surfaces of the bolt insertion holes 24L, 24R at the rear of the shorter side portions 21L, 21R, notches 39L, 39R are formed toward the oil feed paths 38L, 38R so as to communicate the bolt insertion holes 24L, 24R and the oil feed paths 38L, 38R.

Figure 12:
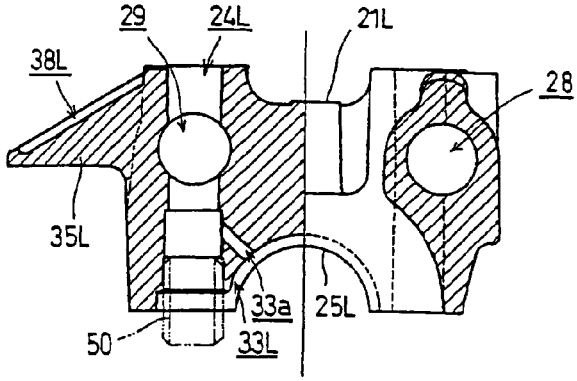
FIG. 12 is a cross sectional view taken along the line XII—XII in FIG. 5.

As shown in FIG. 12, a communication hole 33*a* formed from the midpoint of the oil groove 33L of the left semi-arcuate surface 25L obliquely upward penetrates the bolt insertion hole 24L and communicates with the oil groove 33L and the bolt insertion hole 24L.

Cylindrical knock pins 50, 50 are fitted about halfway into the bolt insertion hole 24L and the bolt insertion hole 23R located at the opposed corners of the cam holder 20 from the reverse face thereof (See double dashed line in FIG. 9 and FIG. 12) in advance, and are used for positioning when mounting the cam holder 20 to the cylinder head 4.

The rocker arm shafts 41, 42 are inserted into the circular holes 28, 29 at the front and the back of the cam holder 20, two intake-side rocker arms 43, 43 are pivotably supported by the rear rocker arm shaft 41, and one exhaust-side rocker arm 44 is pivotably supported by the front rocker arm shaft 42.

The cam holder 20 assembled in this manner is mounted on the cylinder head 4 in a state in which the camshaft 40 is rotatably interposed between the semi-arcuate surfaces 25L, 25R.

In this case, the knock pins 50, 50 fitted into the bolt insertion hole 24L and the bolt insertion hole 23R are inserted into the bolt holes on the side of the cylinder head 4 for aligning the cam holder 20.

The mating surfaces 26, 27 on the reverse face of the cam holder 20 are fitted to the mating surface at the upper end of the cylinder head 4, and flanged bolts 45 are inserted into the bolt insertion holes 23L, 23R, 24L, 24R at the four corners, and screwed into and fixed to the cylinder head 4.

The flanged bolts 45 pass through the through holes of the orthogonal rocker arm shafts 41, 42, and pass through the knock pin 50 at the position where the knock pin 50 is fitted.

Figure 3:
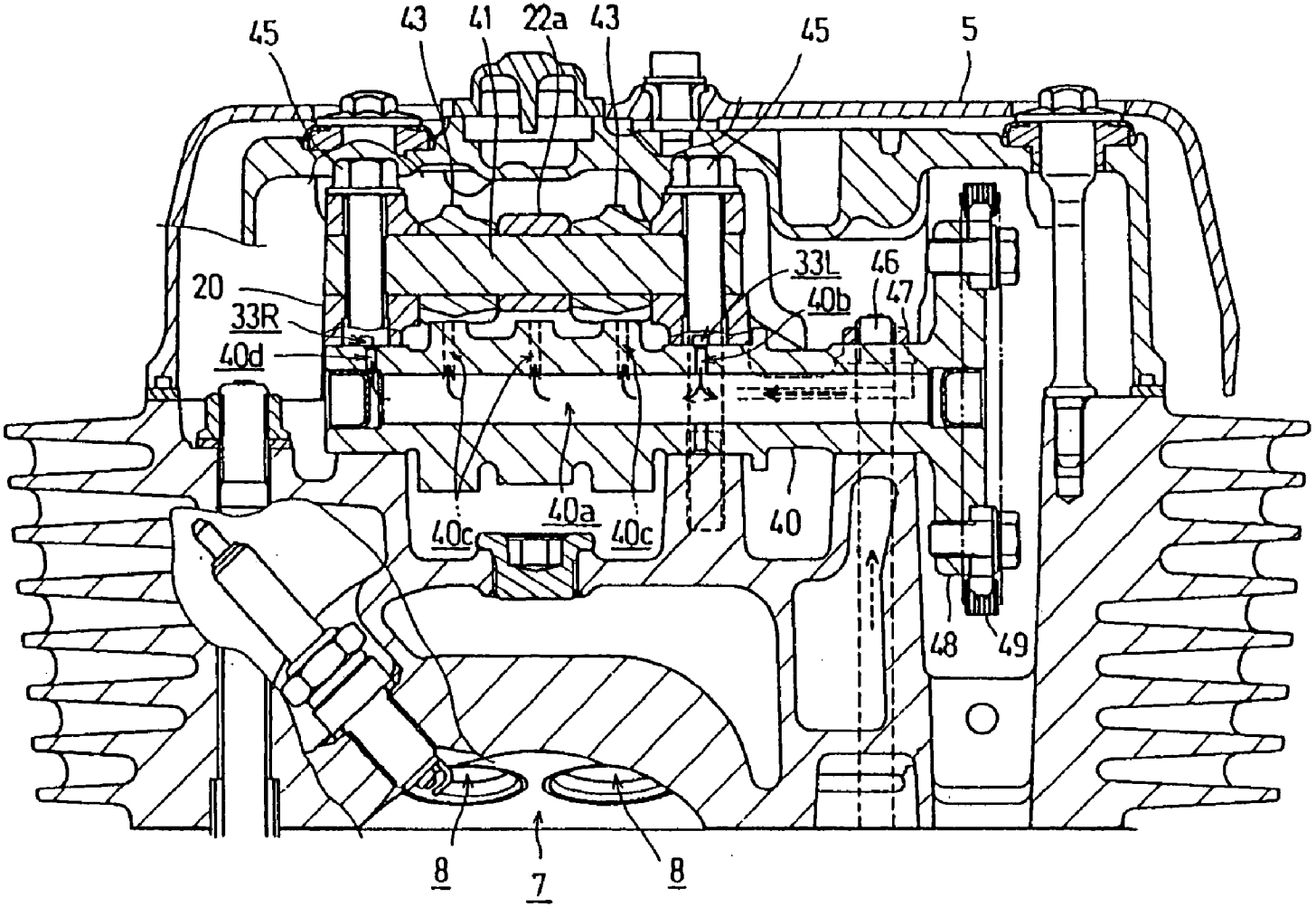
FIG. 3 is a cross sectional view taken along the line III—III in FIG. 2.

A stud bolt 46 for integrally securing the cylinder head 4 together with the cylinder block 3 to the engine case 2 passes through the bolt insertion hole 31*a* of the distal end bolt mounting boss 31 of the extension 30 of the cam holder 20, and a flanged nut 47 is screwed into the threaded portion at the upper end screw portion to secure the cam holder 20 together (See FIG. 3).

When the cam holder 20 is mounted to the cylinder head 4, the ends of the intake-side rocker arms 43, 43, one end of which is abutted against the cam surface of the camshaft 40, abut against the stem ends 10*c*, 10*c* of the air intake valves 10, 10, and the other end of the exhaust rocker arm 44 abuts against the stem end 11*c* of the exhaust valve 11.

A timing chain 49 is wound between a driven sprocket 48 provided at the end of the camshaft 40 and the crankshaft, and the camshaft 40 is rotated when the internal combustion engine 1 is driven, and the intake-side rocker arms 43, 43 and the exhaust-side rocker arm 44 are pivoted by rotation of the camshaft 40, so that the air intake valves 10, 10 and the exhaust valve 11 are opened and closed at predetermined timings.

The distal end bent portions 36L, 36R of the nose portions 35L, 35R of the cam holder 20 are located substantially above the stem ends 10*c*, 10*c* of the respective reciprocating air intake valves 10, 10.

Lubrication of the valve system by the oil pump will be described below.

Oil pumped by the oil pump passes through the volt insertion hole through which the stud bolt 46 passes, runs down from the bolt insertion hole 31*a* of the bolt mounting boss 31 of the cam holder 20 through the oil groove 32 (See arrows in FIG. 3, FIG. 6), and reaches the bolt insertion hole 24L through which the flanged bolt 45 passes.

Figure 6:
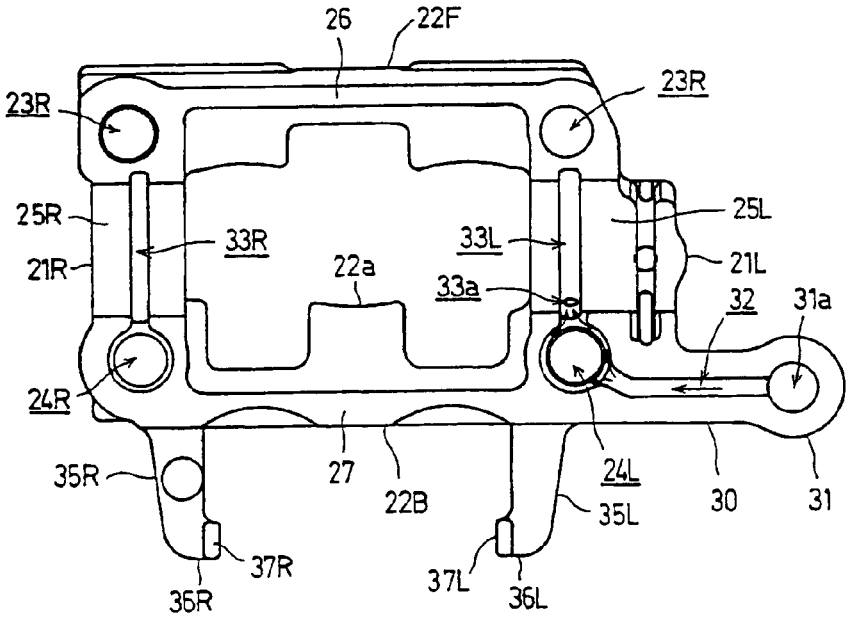
FIG. 6 is a drawing of a reverse face of the cam holder.
Figure 7:
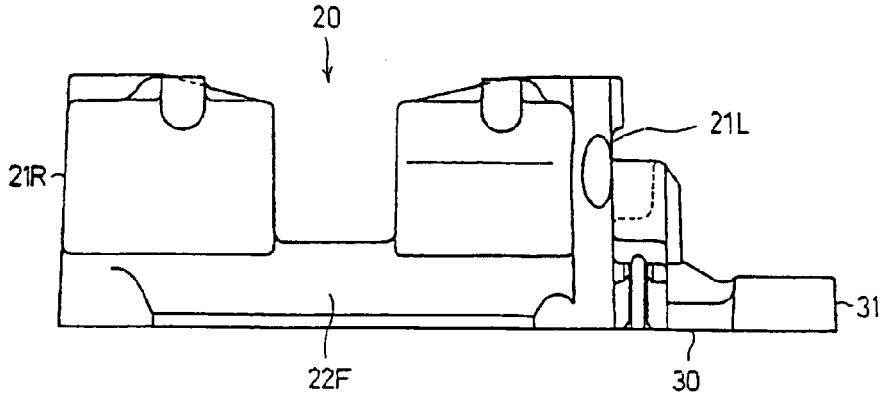
FIG. 7 is a drawing viewed in the direction of an arrow indicated by VII in FIG. 5.
Figure 8:
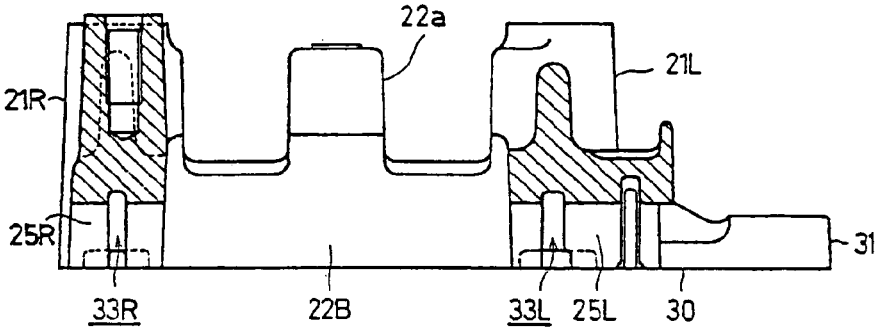
FIG. 8 is a cross-sectional view taken along the line VIII—VIII in FIG. 5.
Figure 9:
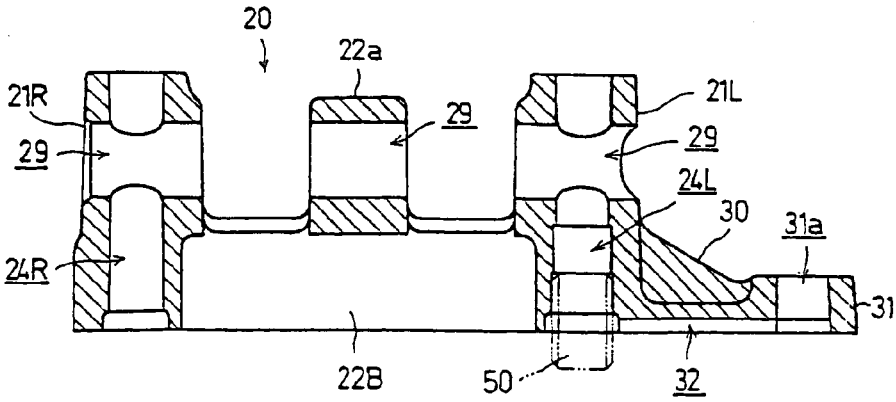
FIG. 9 is a cross sectional view taken along the line IX—IX in FIG. 5.
Figure 10:
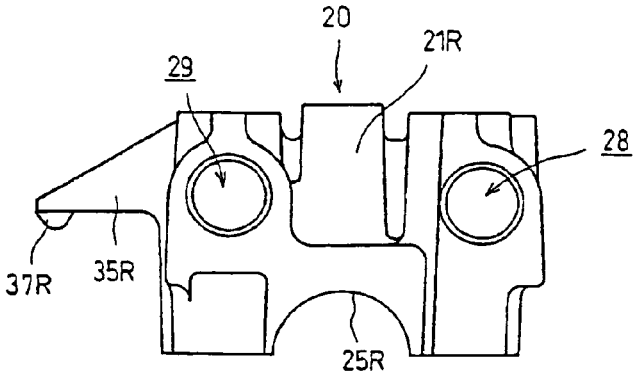
FIG. 10 is a drawing viewed in the direction indicated by an arrow X in FIG. 5.
Figure 11:
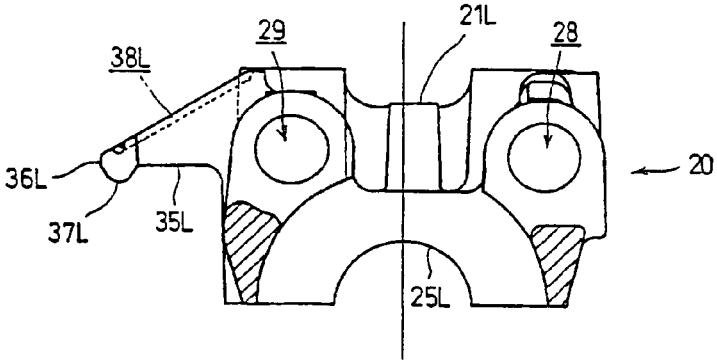
FIG. 11 is a cross sectional view taken along the line XI—XI in FIG. 5.

Oil reached to the bolt insertion hole 24L runs around the periphery of the knock pin 50, run into the oil groove 33L on the semi-arcuate surface 25L which is communicating therethrough, and lubricates the bearing of the camshaft 40 (See an arrow in FIG. 6).

Figure 4:
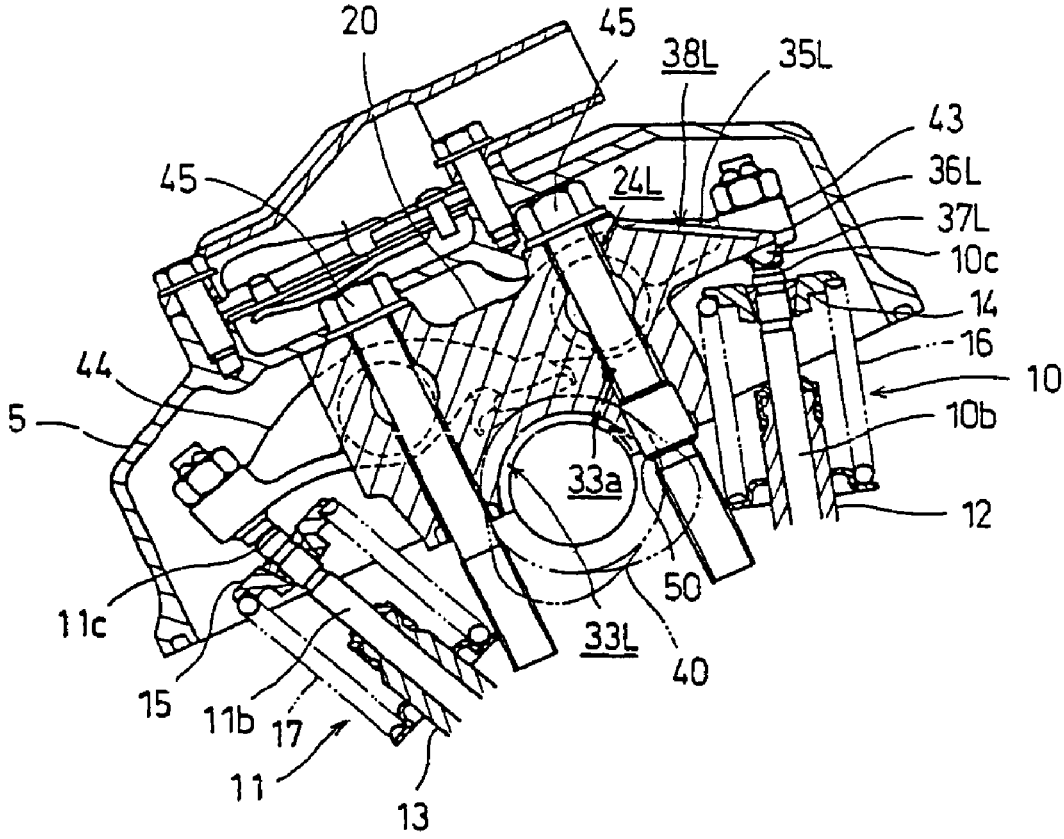
FIG. 4 is a cross sectional view taken along the line IV—IV in FIG. 2.
Figure 5:
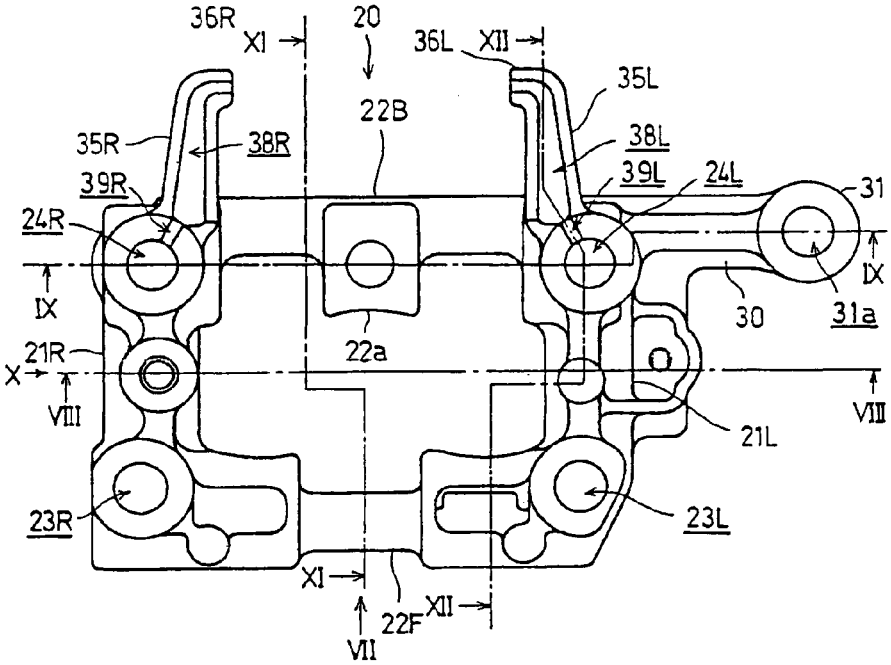
FIG. 5 is a plan view of a cam holder.

As shown by an arrow in FIG. 4, oil passed through the communication hole 33*a* which penetrates from the oil groove 33L obliquely into the bolt insertion hole 24L and returned to the bolt insertion hole 24L runs through the bolt insertion hole 24L which is clogged by the head of the flanged bolt 45 upward, flows out from the notch 39L on the end surface of the opening, and then flows into the trough-like oil feed path 38L on the inclined upper surface of the left nose portion 35L.

Although the inclined oil feed path 38L of the nose portion 35L takes a posture close to horizontal due to forward inclination of the front cylinder head 4, it inclines slightly downwardly toward the distal end. Therefore, oil flowing into the oil feed path 38L is guided by the oil feed path 38L, turns at the distal end bent portion 36L, is discharged from the opening (exit), runs down along the end surface of the opening, and drops from the lower end of the projection 37L onto the stem end 10*c* of the left air intake valve 10.

Oil flowing into the oil groove 33L of the left semi-arcuate surface 25L of the camshaft bearing, on the other hand, passes through an oil hole 40*b* penetrating the camshaft 40 in the radial direction, and is supplied to a center axis hole 40*a* of the camshaft 40 (See an arrow in FIG. 3).

Oil supplied to the center axis hole 40*a* of the camshaft 40 passes through an oil holes 40*c* formed in the respective cam surfaces as shown by arrows in FIG. 3. These oil holes 40*c* supply oil to the sliding surfaces with respect to the rocker arms 43, 44 for lubricating the cam and, simultaneously, the oil passes from the end of the center axis hole 40*a* through an oil hole 40*d* to the oil groove 33R on the right semi-annular surface 25R of the camshaft bearing for lubricating the camshaft 40.

Oil further reaches the right bolt insertion hole 24R which is in communication with the oil groove 33R, flows through the bolt insertion hole 24R clogged by the head of the flanged bolt 45 upward, flows out from the notch 39R of the end surface of the opening, and flows into the trough-like oil feed path 38R on the inclined upper surface of the right projection 35R.

Oil flowing into the oil feed path 38R of the right nose portions 35R is guided by the oil feed path 38R as in the case of the left oil feed path 38L described above, turns at the distal end bent portion 36R, is discharged from the opening (exit), runs down along the end surface of the opening and drops from the lower end of the projection 37R onto the stem end 10*c* of the right air intake valve 10 for lubricating the valve stem 10*b*.

As described above, oil is guided by the trough-shaped oil feed paths 38L, 38R formed on the upper surface of the left and the right nose portions 35L, 35R formed integrally with the cam holder 20 so as to project therefrom, is fed to the stem ends 10*c*, 10*c* of the left and the right air intake valves 10, 10, respectively, so that the valve stems 10*b*, 10*b* of the air intake valves 10, 10 located at the highest level of the valve system can be sufficiently lubricated.

The stem end 11*c* of the exhaust valve 11 is located at a lower level than the stem end 10*c* of the air intake valve 10 due to inclination of the cylinder, and thus oil supply is sufficiently performed by the motion of the timing chain 49 which sweeps oil up.

Since the oil feed paths 38L, 38R for feeding lubricant to the upper end of the valve stem are formed integrally with the cam holder 20 so as to project therefrom, the number of components is reduced, and it is not necessary, for example, to secure a plurality of components together with a single screw. Therefore, reliability is improved, satisfactory assemblability is achieved, and the cost is reduced.

Since the projections 37L, 37R protruding downward are formed at the openings (exits) of the oil feed paths 38L, 38R, lubricant can easily run down along the surface of the projections 37L, 38R and drops exactly on the valve stems 10*b*, 10*b*.

Since part of oil supplied from the center axis hole 40*a* of the camshaft 40 to the cam is distributed for lubricating the valve stems 10*b*, 10*b*, it is not necessary to additionally provide an oil path specific for lubricating the valve stem, and the valve stems 10*b*, 10*b* can be lubricated using the bolt insertion holes 24L, 24R.

Since oil supply to the valve stems 10*b*, 10*b* of the left and the right air intake valves 10, 10 is performed via the bolt insertion holes 24L, 24R, and the oil feed paths 38L, 38R which are independent from each other, oil can be supplied to the respective valve stems 10*b*, 10*b* equally irrespective of the posture of the internal combustion engine 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A lubricating structure for an OHC internal combustion engine comprising a cam holder with a shorter side portion and a longer side portion and a circular hole adapted to accommodate a rocker arm shaft, wherein the cam holder includes a nose portion which projects integrally from the longer side portion of the cam holder towards a valve stem, the nose portion being an oil feed path for feeding a lubricant to an upper end of a valve, wherein the nose portion includes a lower edge that is integrally joined to the longer side portion at a position below a center of the circular hole.

2. The lubricating structure of the OHC internal combustion engine according to claim 1, wherein the oil feed path is trough-shaped, and wherein the nose portion projects in a direction substantially parallel to the shorter side of the cam holder.

3. The lubricating structure of the OHC internal combustion engine according to claim 1, wherein a convex-shaped projection is suspended downward from a distal end portion of the bent part of the rear end of the nose portion at an exit of the oil feed path, the projection for dropping the lubricant directly onto the upper end of the valve stem.

4. The lubricating structure of the OHC internal combustion engine according to claim 1, wherein part of the lubricant for lubricating a cam is supplied to the oil feed path through a notch in the cam holder, the notch extending diagonally between a bolt insertion hole and the oil feed path.

5. The lubricating structure of the OHC internal combustion engine according to claim 1, wherein the internal combustion engine includes a plurality of valves arranged in a direction of a camshaft, the oil feed path being a plurality of oil feed paths, and wherein each of the valves is formed with an oil path that independently communicates with one of the plurality of oil feed paths.

6. The lubricating structure of the OHC internal combustion engine according to claim 1, wherein the cam holder rotatably clamps a camshaft with respect to the cylinder head, a bottom side of the cam holder having a mating surface and semi-arcuate surfaces formed with an oil path allowing the lubricant to flow to a bolt insertion hole leading upward to the oil feed path on an upper side of the cam holder.

7. The lubricating structure of the OHC internal combustion engine according to claim 1, wherein the nose portion is formed on an inclined upper surface of the cam holder so as to project rearwardly, the nose portion being triangular-shaped in side view, and having an upper surface inclined downward, and wherein a side of the triangular-shaped nose portion integrally projecting from the longer side portion of the cam holder extends in a height direction of the longer side portion.

8. The lubricating structure of the OHC internal combustion engine according to claim 7, the oil feed path is formed on the upper surface inclined downward.

9. The lubricating structure of the OHC internal combustion engine according to claim 6, wherein the lubricant flowing through the oil feed path is discharged at an exit of the oil feed path, the exit being disposed substantially above the upper end of the valve stem.

10. A lubricating structure for an OHC internal combustion engine comprising:

a cam holder with a shorter side portion and a longer side portion; and an oil feed path for feeding a lubricant to an upper end of a valve stem formed on an inclined upper surface of a rearwardly projecting extension projecting from a longer side portion of the cam holder, a distal end of the rearwardly projecting extension having a bent part bending toward a front or a back of the cam holder, wherein the nose piece projects from the longer side portion of the cam holder along a line extending in a height direction of the cam holder, wherein the rearwardly projecting extension of the cam holder includes a convex-shaped projection, the convex-shaped projection being suspended downward from the distal end of the bent part of rearwardly projecting extension at an exit of the oil feed path in order to drop the lubricant from the oil feed path directly onto the upper end of the valve stem.

11. The lubricating structure of the OHC internal combustion engine according to claim 10, wherein the oil feed path is trough-shaped.

12. The lubricating structure of the OHC internal combustion engine according to claim 10, wherein the oil feed path is an exposed groove cut into the inclined upper surface of the rearwardly projecting extension of the cam holder.

13. The lubricating structure of the OHC internal combustion engine according to claim 10, wherein part of the lubricant for lubricating a cam is supplied to the oil feed path through a notch in the cam holder, the notch extending diagonally between a bolt insertion hole and the oil feed path.

14. The lubricating structure of the OHC internal combustion engine according to claim 10, wherein the internal combustion engine includes a plurality of valves arranged in a direction of a camshaft, the oil feed path being a plurality of oil feed paths, and wherein each of the valves is formed with an oil path that independently communicates with one of the plurality of oil feed paths.

15. The lubricating structure of the OHC internal combustion engine according to claim 10, wherein the cam holder rotatably clamps a camshaft with respect to the cylinder head, a bottom side of the cam holder having a mating surface and semi-arcuate surfaces formed with an oil path allowing the lubricant to flow to a bolt insertion hole leading upward to the oil feed path on an upper side of the cam holder.

16. The lubricating structure of the OHC internal combustion engine according to claim 10, wherein the rearwardly projecting extension is a nose portion formed on the inclined upper surface of the cam holder so as to project rearwardly, the nose portion being triangular-shaped in side view, and having an upper surface inclined downward, and wherein a lower edge of the triangular-shaped nose portion is substantially orthogonal to the longer side portion of the cam holder.

17. The lubricating structure of the OHC internal combustion engine according to claim 16, the oil feed path is formed on the inclined upper surface.

18. The lubricating structure of the OHC internal combustion engine according to claim 15, wherein the lubricant flowing through the oil feed path is discharged at the exit of the oil feed path, the exit being disposed substantially above the upper end of the valve stem.

19. A lubricating structure for an OHC internal combustion engine comprising a cam holder, wherein an oil feed path for feeding a lubricant to the upper end of a valve stem is formed integrally with the cam holder so as to project therefrom, wherein a nose portion is formed on an inclined upper surface of the cam holder so as to project from a longer side portion of the cam holder, the nose portion being triangular-shaped in side view, having a lower edge projecting orthognally from a middle portion of the longer side portion, and having an upper surface on which the oil feed path in formed, the upper surface inclined downward from a top of the cam holder and meeting and lower edge at a rear end of the nose portion, wherein the rear end of the nose portion is slightly bent.

20. The lubricating structure of the OHC internal combustion engine according to claim 1, wherein the nose portion of the cam holder includes an exposed groove, the exposed groove being the oil feed path.

21. The lubricating structure of the OHC internal combustion engine according to claim 1, wherein the nose portion projecting from the cam holder is disposed outside in a lateral direction with respect to a position of the valve.

22. The lubricating structure of the OHC internal combustion engine according to claim 10, wherein the nose portion projecting from the cam holder is disposed outside in a lateral direction with respect to a position of the valve.

23. The lubricating structure of the OHC internal combustion engine according to claim 19, wherein the nose portion projecting from the cam holder is disposed outside in a lateral direction with respect to a position of the valve.

* * * * *